US010094620B2

(12) United States Patent
Renz et al.

(10) Patent No.: US 10,094,620 B2
(45) Date of Patent: Oct. 9, 2018

(54) STACKED PLATE HEAT EXCHANGER

(71) Applicant: Mahle International GmbH, Stuttgart (DE)

(72) Inventors: Marco Renz, Esslingen (DE); Bernd Schmollinger, Illingen (DE); Henning Schroeder, Stuttgart (DE); Volker Velte, Oetisheim (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/545,312

(22) PCT Filed: Jan. 14, 2016

(86) PCT No.: PCT/EP2016/050631
§ 371 (c)(1),
(2) Date: Jul. 20, 2017

(87) PCT Pub. No.: WO2016/116345
PCT Pub. Date: Jul. 28, 2016

(65) Prior Publication Data

US 2018/0010859 A1 Jan. 11, 2018

(30) Foreign Application Priority Data

Jan. 21, 2015 (DE) ..... 10 2015 200 952

(51) Int. Cl.
*F28D 9/00* (2006.01)
*F28D 7/00* (2006.01)

(52) U.S. Cl.
CPC ..... *F28D 9/0093* (2013.01); *F28D 7/0075* (2013.01); *F28D 9/005* (2013.01); *F28D 7/0066* (2013.01)

(58) Field of Classification Search
CPC .... F28D 7/0075; F28D 7/0066; F28D 9/0093; F28D 9/005
(Continued)

(56) References Cited

U.S. PATENT DOCUMENTS 8,393,384 B2 3/2013 Velte et al.
2008/0264609 A1 10/2008 Lutz et al.

FOREIGN PATENT DOCUMENTS

DE 102005044291 A1 3/2007
EP 1985953 A1 10/2008
(Continued)

OTHER PUBLICATIONS

German Search Report for DE-102015200952.1, dated Dec. 16, 2015.

*Primary Examiner* — Devon Russell
(74) *Attorney, Agent, or Firm* — Fishman Stewart PLLC

(57) ABSTRACT

A stacked-plate heat exchanger may include a high-temperature (HT) coolant circuit, a low-temperature (NT) coolant circuit, heat exchanger plates stacked upon one another and through which two coolants and a medium to be cooled may flow, and an obstruction configured to force a deflection of one of the coolants in the low-temperature coolant circuit. The two coolants may have different temperature levels in the high-temperature and low-temperature coolant circuits. The heat exchanger plates may include a partition wall separating the high-temperature and low-temperature coolant circuits from each other. The high-temperature and low-temperature coolant circuits may include a central HT coolant inlet and a central NT coolant outlet, respectively, adjacent to the partition wall and together forming a teardrop shape separated by the partition wall. The HT coolant inlet may have a part-circle-like shape and the NT coolant outlet may have a triangular shape, each having one side formed by the partition wall.

20 Claims, 1 Drawing Sheet

(58) Field of Classification Search
USPC ..... 165/165, 166
See application file for complete search history.

(56) References Cited

FOREIGN PATENT DOCUMENTS

| | | | |
|---|---|---|---|
| EP | 1700079 | B1 | 9/2010 |
| EP | 2412950 | A1 | 2/2012 |
| WO | WO-2007/045406 | A1 | 4/2007 |
| WO | WO-2013/162822 | A1 | 10/2013 |
| WO | WO-2014/009537 | A1 | 1/2014 |

STACKED PLATE HEAT EXCHANGER

CROSS-REFERENCE TO RELATED APPLICATIONS

This application claims priority to International Patent Application No. PCT/EP2016/050631, filed on Jan. 14, 2016, and German Patent Application No. DE 10 2015 200 952.1, filed on Jan. 21, 2015, the contents of both of which are hereby incorporated by reference in their entireties.

TECHNICAL FIELD

The present invention relates to a stacked-plate heat exchanger, in particular a charge-air cooler, with a high-temperature coolant circuit and a low-temperature coolant circuit.

BACKGROUND

A constantly increasing cooling requirement can be observed in modern motor vehicles, for example in the area of the charge-air cooling, as a result of which the demands on the cooling and air-conditioning systems are constantly increasing. An improved use of heat sources and heat sinks can lead to a greater degree of utilisation and moreover to a reduction in fuel consumption. Cooling systems available on the market at present for charge-air cooling often comprise a stacked-plate heat exchanger which is constituted in one stage. The efficiency that can be achieved with the one-stage temperature regulation is however limited. In order to improve the efficiency of cooling circuits, in particular for the cooling of fluids, such as for example coolants, refrigerants, oil, exhaust air or charge air, it is therefore advisable in some cases to cool and heat a fluid over two stages. The drawback with the two-stage temperature regulation of fluids, however, is that the use of two heat exchangers conventionally connected one after the other is associated with much higher costs and an increase space requirement.

For this reason, a so-called stacked-plate heat exchanger is often used, which comprises both a high-temperature coolant circuit HT as well as a low-temperature coolant circuit NT. The space requirement can be reduced considerably with such a combined stacked-plate heat exchanger. A drawback with such combined stacked-plate heat exchangers, however, is their comparatively complex production.

There is known from DE 10 2005 044 291 A1 a stacked-plate heat exchanger, in particular a charge-air cooler, with a plurality of elongate plates which are stacked upon one another and connected, for example soldered, to one another, which plates delimit a cavity for conducting a medium to be cooled, such as for example charge air, in the longitudinal direction of the plates, and a further cavity for conducting a coolant, wherein the plates comprise in each case an inlet connection and an outlet connection for the medium to be cooled. In order to be able to create a stacked-plate heat exchanger which on the one hand can be produced cost-effectively and on the other hand has a long service life even at high temperatures, at least one coolant connection extends partially around a connection for the medium to be cooled.

A further stacked-plate heat exchanger is known from EP 1 700 079 B1, which is designed to exchange heat between at least one high-temperature fluid and at least one cooling fluid and comprises a plurality of stacked heat exchanger plates soldered to one another, each one of which comprises: an inlet opening for the high-temperature fluid, an outlet opening for the oil fluid, an outlet opening for the high-temperature fluid as well as an inlet opening for the cooling fluid.

A drawback with the stacked-plate heat exchangers known from the prior art, however, is that they too, even in mass production, can only be produced in a comparatively complex way and are therefore expensive.

The present invention is therefore concerned with the problem of providing an improved or at least an alternative embodiment for a stacked-plate heat exchanger of the generic type, said embodiment enabling a two-stage temperature regulation of a medium to be cooled with an increased heat transfer and also being able to be produced at a favourable cost.

According to the invention, this problem is solved by the subject-matter of the independent claims. Advantageous embodiments are the subject-matter of the dependent claims.

SUMMARY

The present invention is based on the general idea of modifying a stacked-plate heat exchanger known per se, in such a way that the latter does not, as previously known from the prior art, provide two high-temperature coolant inlets and two low-temperature coolant outlets in the region of a partition wall, but only one thereof in each case in the region of this partition wall. The stacked-plate heat exchanger according to the invention, which for example can be constituted as a charge-air cooler, thus comprises a high-temperature coolant circuit HT and a low-temperature coolant circuit NT with heat exchanger plates, which are stacked upon one another and through which two coolants having a different temperature level in high-temperature coolant circuit HT and in low-temperature coolant circuit NT, on the one hand, and a medium to be cooled, for example charge air, on the other hand, flow. According to the invention, the heat exchanger plates comprise a partition wall for the separation of high-temperature coolant circuit HT and low-temperature coolant circuit NT, as a result of which it is possible to combine two coolant circuits with different temperature levels in a single stacked-plate heat exchanger. Moreover, the stacked-plate heat exchanger according to the invention comprises in its high-temperature coolant circuit HT a single, central high-temperature coolant inlet adjacent to the partition wall, whilst the low-temperature coolant circuit NT also comprises a single, central low-temperature coolant outlet adjacent to the partition wall. As a result of the reduction in the coolant inlets and the coolant outlets, it is therefore not only possible to constitute the individual heat exchanger plates and thus the entire stacked-plate heat exchanger as a whole more cost effectively, but a much more homogeneous, i.e. more uniform and therefore better flow of the different coolants through the heat exchanger plates can also be forced, as a result of which an overall better heat transfer can be forced. Apart from the more cost-effective producibility of the stacked-plate heat exchanger according to the invention, the latter is therefore, in addition, also more powerful.

In an advantageous development of the solution according to the invention, the stacked-plate heat exchanger is constituted as a counter-flow cooler. The medium to be cooled, for example charge air, flows in the opposite direction to the coolants in such a counter-flow cooler, as a result of which not only can better cooling be forced, but also boiling of the individual coolants can be avoided, this having to be avoided at all costs. Since damage may be caused in the event of boiling of the coolants, the service life of the stacked-plate heat exchanger according to the invention can be extended with the counter-flow principle used according to the invention. It is the case that, with cooling in the counter-flow principle, the actual cooling effect is generally greater than in the case of identical directions.

The heat exchanger plates expediently comprise a peripheral upturned edge, by means of which they can be soldered to an adjacent heat exchanger plate, in particular one that is disposed above or below, wherein the partition wall is connected to the edge in each case at the longitudinal end side. The partition wall thus runs through the respective heat exchanger plate in the transverse direction and is connected at the one end to an edge and at the other end to the edge lying opposite. Such a heat exchanger plate usually has the shape of a rectangle, the narrow sides whereof are however rounded in the shape of a semicircle. The partition wall preferably runs centrally, but can be displaced virtually arbitrarily, according to the required cooling capacity of the low-temperature coolant circuit or the high-temperature coolant circuit, in the longitudinal direction of that heat exchanger plate. The cooling capacity of the two circuits can thus be adjusted. The arrangement of the partition wall can preferably be adjusted simply by the corresponding positioning of a separating web in the stamping tool.

In a further advantageous embodiment of the solution according to the invention, the high-temperature coolant outlet and the low-temperature coolant outlet together have a teardrop shape which is separated by the partition wall. Such a teardrop shape is generally regarded as having comparatively favourable flow characteristics, as a result of which a pressure loss on the charge-air side can be minimised. The high-temperature coolant inlet can have a part-circle-like shape, whilst the low-temperature coolant outlet has a triangular shape and lies with one of its sides adjacent to the partition wall, i.e. one of its sides is formed as a part of the partition wall itself. The two sides of the low-temperature coolant outlet not lying adjacent to the partition wall are disposed at an acute angle to the partition wall and, at their longitudinal ends remote from the partition wall, merge into one another via a circular segment portion, i.e. are rounded. The teardrop shape does not therefore have an acutely tapered end, but rather is constituted rounded in this region, which again has a favourable effect on flow for the coolant of the low-temperature circuit flowing against the charge air flow.

An obstruction, which forces a deflection of the low-temperature coolant, is expediently disposed in the region of the circular segment portion described above. As a result of this obstruction, it is thus not possible for the low-temperature coolant to pass directly to the low-temperature coolant outlet disposed centrally at the partition wall and thus to flow away there without significant heat exchange. On the contrary, the obstruction forces a flow around the latter, as a result of which a flow now also takes place for example through so-called dead regions, in regions through which it was difficult previously for the low-temperature coolant to flow, so that a much better heat transfer also takes place there.

In a further advantageous embodiment of the solution according to the invention, an outer contour of the high-temperature coolant inlet transforms in an aligned manner into an outer contour of the low-temperature coolant outlet. As a result of the aligned transition of the two outer contours into one another, the charge air flow can flow free from disruption, as a result of which a pressure loss can be minimised.

Further important features and advantages of the invention emerge from the sub-claims, from the drawings and from the respective description of the figures on the basis of the drawings.

It is understood that the features mentioned above and still to be explained below can be used not only in the stated combination in each case, but also in other combinations or in isolation without departing from the scope of the present invention.

Preferred examples of embodiment of the invention are represented in the drawings and explained in greater detail in the following description, wherein identical reference numbers relate to identical or similar or functionally identical components.

BRIEF DESCRIPTION OF THE DRAWINGS

In the figures, in each case diagrammatically.

DETAILED DESCRIPTION

Figure 1:
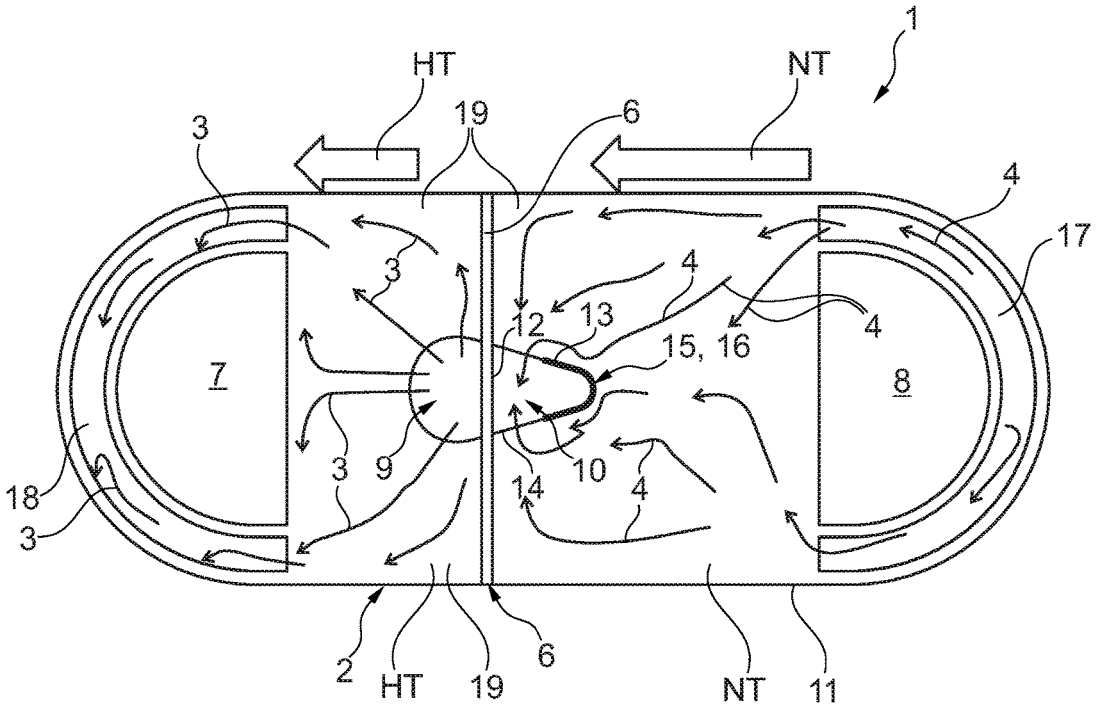
FIG. 1 shows an inventive heat exchanger plate of an also inventive stacked-plate heat exchanger in a plane of the two coolant circuits differing in terms of their temperature level.

According to FIG. 1, a sacked-plate heat exchanger 1 according to the invention, which for example is constituted as a charge air cooler, comprises a high-temperature coolant circuit HT and a low-temperature coolant circuit NT. Individual coolant circuits HT and NT are formed by heat exchanger plates 2 stacked upon one another, through which two coolants 3, 4 with a different temperature level in high-temperature coolant circuit HT and low-temperature coolant circuit NT flow. In between in a plane parallel thereto, a medium 5 to be cooled, for example charge air, flows (see FIG. 2). According to the invention, heat exchanger plates 2 comprise a partition wall 6, which separates high-temperature coolant circuit HT and low-temperature coolant circuit NT from one another. This partition wall 6 does not pass through in the plane of medium 5, i.e. in the charge air plane, as a result of which the charge air or medium 5 can flow from a medium inlet 7 over the entire length of respective heat exchanger plate 2 up to a medium outlet 8 (see FIG. 2). Medium inlet 7 and medium outlet 8 are constituted as a segment of a circle, in particular in the shape of a semicircle.

According to the invention, high-temperature coolant circuit HT comprises a single, central high-temperature coolant inlet 9 adjacent to partition wall 6 and low-temperature coolant circuit NT also comprises a single, central low-temperature coolant outlet 10 adjacent to partition wall 6.

Figure 2:
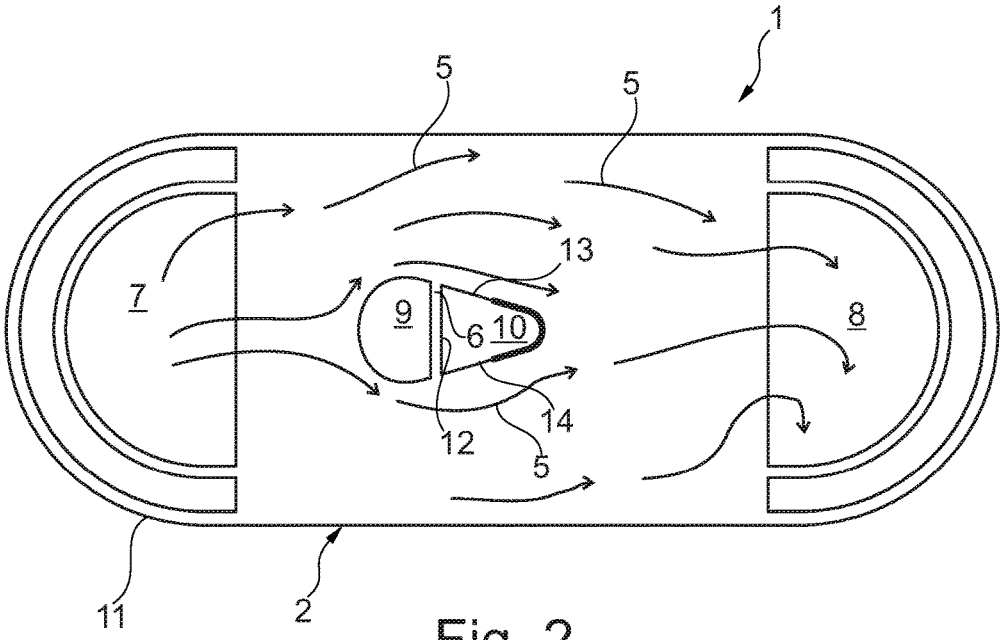
FIG. 2 shows a representation as in FIG. 1, but in a median plane, i.e. in a plane of the respective heat exchanger plates that is parallel to FIG. 1.

Generally, stacked-plate heat exchanger 1 is constituted as a so-called counter-flow cooler, which means that coolant 3 and coolant 4 flow in the same direction (see FIG. 1), but medium 5 to be cooled, i.e. the charge air, flows in the opposite direction (see FIG. 2).

Heat exchanger plates 2 comprise a peripheral, upturned edge 11, by means of which they are connected, in particular soldered, to an adjacent heat exchanger plate 2. Partition wall 6 is connected to edge 11 in each case at the longitudinal end side and meets the latter at right angles.

Considering once again high-temperature coolant inlet 9 and low-temperature coolant outlet 10 adjacent to the latter and separated by partition wall 6, it can be seen that the latter together form a teardrop shape, which is separated by partition wall 6. Such a teardrop shape offers the great advantage that both high-temperature coolant inlet 9 and low-temperature coolant outlet 10 have extremely favourable flow characteristics with regard to the flow of medium 5 (see FIG. 2), i.e. the charge air. According to the invention, an outer contour of high-temperature coolant inlet 9 transforms in an aligned manner into an outer contour of low-temperature coolant outlet 10, as a result of which a shape with particularly favourable flow characteristics can be achieved, which leads to just a small pressure loss in the flow path of medium 5.

High-temperature coolant inlet 9 has a part-circle-like shape, whilst low-temperature coolant outlet 10 has a triangular shape and lies with an edge 12 adjacent to partition wall 6. Partition wall 6 can also form side 12. The two sides 13 and 14 not lying adjacent to partition wall 6 form an acute angle with side 12, whereas they merge into one another rounded off in a circular segment portion 15 at their longitudinal ends remote from partition wall 6. An obstruction 16 is disposed in the region of circular segment portion 15, said obstruction forcing a deflection of low-temperature coolant 4 (see FIG. 1). It can thus be ensured that a low-temperature coolant 4 flowing from a low-temperature coolant inlet 17 (see FIG. 1) cannot pass directly into low-temperature coolant outlet 10, but rather is deflected by obstacle 16 and a uniform and homogeneous through-flow over the entire area, in particular so-called corner region 19, is thus forced. In the same way, high-temperature coolant 3 also flows uniformly through high-temperature coolant circuit HT or its regions/corner region 19, said high-temperature coolant entering via high-temperature coolant inlet 9 and flowing out via a high-temperature coolant outlet 18 disposed around medium inlet 7 in the form of a semicircle.

With heat exchanger plates 2 according to the invention and inventive stacked-plate heat exchanger 1 produced therefrom, not only can a markedly improved flow and therefore a greatly increased heat transfer be achieved, but individual heat exchanger plates 2 can be stamped and therefore produced much more easily on account of the now only one high-temperature coolant inlet 9 and low-temperature coolant outlet 10. Partition wall 6 is impressed by means of a corresponding stamping tool and is variably displaceable in the longitudinal direction of heat exchanger plate 2. With centrally disposed inlets and outlets 9, 10, a homogeneous through-flow of corner regions 19 can also be forced. Both a coolant side, as well as a medium side, i.e. charge-air side, homogeneous through-flow can thus be achieved. On account of the smaller number of passages, the parts geometry can be designed more simply, as a result of which increased process reliability can be achieved and smaller solder areas are required. A simpler forming tool can also be used due to only a single coolant inlet and coolant outlet 9, 10, which in turn leads to lower tool costs. As a result of the optimised flow distribution, the overall efficiency of stacked-plate heat exchanger 1 can be increased, which leads to a reduction in the charge-air or medium outlet temperature of up to 1 Kelvin. Conversely, this means that heat exchanger plate 2 could be designed in a more compact manner with the same performance. Stacked heat exchanger 1 is conceivable not only as a charge-air cooler, but can in principle be used for all coolers, as for example for oil coolers. Obstruction 16 can be impressed together with heat exchanger plate 2 and partition wall 6 or it can be formed as a separate insert part. Moreover, all circuits, both on the coolant side and on the medium side, are of course also conceivable and combinable. In particular, parallel flow variants are also conceivable.

The invention claimed is:

1. A stacked-plate heat exchanger comprising:

a high-temperature (HT) coolant circuit through which a high-temperature coolant flows and a low-temperature (NT) coolant circuit through which a low-temperature coolant flows;

heat exchanger plates stacked upon one another and through which the two coolants and a medium to be cooled flow, the two coolants having a different temperature level from each other in the high-temperature coolant circuit and in the low temperature coolant circuit;

wherein the heat exchanger plates include a partition wall separating the high-temperature coolant circuit from the low-temperature coolant circuit;

wherein the high-temperature coolant circuit includes a central HT coolant inlet adjacent to the partition wall, and the low-temperature coolant circuit includes a central NT coolant outlet adjacent to the partition wall;

wherein the HT coolant inlet and the NT coolant outlet together form a teardrop shape, which is divided by the partition wall; and wherein the HT coolant inlet has a rounded shape and the NT coolant outlet has a triangular shape, the HT coolant inlet and the NT coolant outlet each have one side formed by the partition wall.

2. The stacked-plate heat exchanger according to claim 1, wherein the stacked-plate heat exchanger is configured as a counter-flow cooler.

3. The stacked-plate heat exchanger according to claim 1, wherein each heat exchanger plate includes a peripheral upturned edge by which each heat exchanger plate is soldered to an adjacent heat exchanger plate, wherein the partition wall is connected to a longitudinal end side of the edge at a right angle in each case.

4. The stacked-plate heat exchanger according to claim 1, wherein two sides of the NT coolant outlet not lying adjacent to the partition wall are disposed at an acute angle to the one side formed by the partition wall, and, at longitudinal ends of the two sides remote from the partition wall, merge into one another via a rounded portion.

5. The stacked-plate heat exchanger according to claim 4, further comprising an obstruction configured to force a deflection of one of the coolants and that is disposed in a region adjacent to the rounded portion.

6. The stacked-plate heat exchanger according to claim 1, wherein an outer contour of the HT coolant inlet is aligned with an outer contour of the NT coolant outlet.

7. The stacked-plate heat exchanger according to claim 1, wherein at least one of:

an HT coolant outlet is disposed in the form of a semicircle around an inlet for the medium; and an NT coolant inlet is disposed in the form of a semicircle around an outlet for the medium.

8. The stacked-plate heat exchanger according to claim 2, wherein each heat exchanger plate includes a peripheral upturned edge by which each heat exchanger plate is soldered to an adjacent heat exchanger plate, wherein the partition wall is connected to a longitudinal end side of the edge at a right angle in each case.

9. The stacked-plate heat exchanger according to claim 2, wherein two sides of the NT coolant outlet not lying adjacent to the partition wall are disposed at an acute angle to the one side formed by the partition wall, and, at longitudinal ends of the two sides remote from the partition wall, merge into one another via a rounded portion.

10. The stacked-plate heat exchanger according to claim 9, further comprising an obstruction configured to force a deflection of one of the coolants and that is disposed in a region adjacent to the rounded portion.

11. The stacked-plate heat exchanger according to claim 3, wherein two sides of the NT coolant outlet not lying adjacent to the partition wall are disposed at an acute angle to the one side formed by the partition wall, and, at longitudinal ends of the two sides remote from the partition wall, merge into one another via a rounded portion.

12. The stacked-plate heat exchanger according to claim 11, further comprising an obstruction configured to force a deflection of one of the coolants and that is disposed in a region adjacent to the rounded portion.

13. The stacked-plate heat exchanger according to claim 2, wherein an outer contour of the HT coolant inlet is aligned with an outer contour of the NT coolant outlet.

14. The stacked-plate heat exchanger according to claim 2, wherein at least one of:

an HT coolant outlet is disposed in the form of a semicircle around an inlet for the medium; and an NT coolant inlet is disposed in the form of a semicircle around an outlet for the medium.

15. The stacked-plate heat exchanger according to claim 3, wherein an outer contour of the HT coolant inlet is aligned with an outer contour of the NT coolant outlet.

16. The stacked-plate heat exchanger according to claim 3, wherein at least one of:

an HT coolant outlet is disposed in the form of a semicircle around an inlet for the medium; and an NT coolant inlet is disposed in the form of a semicircle around an outlet for the medium.

17. The stacked-plate heat exchanger according to claim 4, wherein an outer contour of the HT coolant inlet is aligned with an outer contour of the NT coolant outlet.

18. The stacked-plate heat exchanger according to claim 4, wherein at least one of:

an HT coolant outlet is disposed in the form of a semicircle around an inlet for the medium; and an NT coolant inlet is disposed in the form of a semicircle around an outlet for the medium.

19. A stacked-plate heat exchanger comprising:

a high-temperature (HT) coolant circuit through which a high-temperature coolant flows and a low-temperature (NT) coolant circuit through which a low-temperature coolant flows;

heat exchanger plates stacked upon one another and through which the two coolants and a medium to be cooled flow, the two coolants having a different temperature level from each other in the high-temperature coolant circuit and in the low temperature coolant circuit;

an obstruction configured to force a deflection of the low-temperature coolant in the low-temperature coolant circuit;

wherein the heat exchanger plates include a partition wall separating the high-temperature coolant circuit from the low-temperature coolant circuit;

wherein the high-temperature coolant circuit includes a central HT coolant inlet adjacent to the partition wall, and the low-temperature coolant circuit includes a central NT coolant outlet adjacent to the partition wall;

wherein the HT coolant inlet and the NT coolant outlet together form a teardrop shape, which is divided by the partition wall;

wherein the HT coolant inlet has a rounded shape and the NT coolant outlet has a triangular shape, the HT coolant inlet and the NT coolant outlet each have one side formed by the partition wall;

wherein two sides of the NT coolant outlet lying adjacent to the partition wall are disposed at an acute angle to the one side formed by the partition wall, and, at longitudinal ends of the two sides remote from the partition wall, merge into one another via a portion; and wherein the obstruction is disposed in a region adjacent to the rounded portion.

20. The stacked-plate heat exchanger according to claim 19, wherein an outer contour of the HT coolant inlet is aligned with an outer contour of the NT coolant outlet.

* * * * *